US012305960B2

(12) United States Patent
Nemeyer

(10) Patent No.: US 12,305,960 B2
(45) Date of Patent: May 20, 2025

(54) CONCENTRIC COLLOCATED AIMING DEVICE

(71) Applicant: FIREBIRD ELECTRO-OPTICS, LLC, Holladay, UT (US)

(72) Inventor: Adam Nemeyer, Beaverton, OR (US)

(73) Assignee: FIREBIRD ELECTRO-OPTICS, LLC, Holladay, UT (US)

( * ) Notice: Subject to any disclaimer, the term of this patent is extended or adjusted under 35 U.S.C. 154(b) by 0 days.

(21) Appl. No.: 18/620,067

(22) Filed: Mar. 28, 2024

(65) Prior Publication Data

US 2024/0328754 A1 Oct. 3, 2024

Related U.S. Application Data

(60) Provisional application No. 63/492,713, filed on Mar. 28, 2023.

(51) Int. Cl.
*F41G 3/14* (2006.01)

(52) U.S. Cl.
CPC ..... *F41G 3/145* (2013.01)

(58) Field of Classification Search
CPC ..... G02B 23/00; G02B 23/02; G02B 23/04; G02B 23/10; F41G 3/145; F41G 3/14
See application file for complete search history.

(56) References Cited

U.S. PATENT DOCUMENTS

| | | | | |
|---|---|---|---|---|
| 11,408,979 | B2 * | 8/2022 | Shimon | F41G 7/226 |
| 12,111,043 | B2 * | 10/2024 | Bainter | F21V 21/0885 |
| 2013/0283660 | A1 * | 10/2013 | Matthews | F41G 1/26 42/118 |
| 2015/0234172 | A1 * | 8/2015 | Sigmund | F41G 1/38 359/422 |
| 2016/0216370 | A1 * | 7/2016 | Shimon | G02B 27/0087 |
| 2020/0383558 | A1 * | 12/2020 | Goebel | G01N 21/6456 |
| 2021/0172704 | A1 * | 6/2021 | Nackel | G02B 7/181 |
| 2024/0184092 | A1 * | 6/2024 | Masarik | G02B 23/04 |
| 2024/0247796 | A1 * | 7/2024 | Bainter | F21V 21/0885 |

* cited by examiner

*Primary Examiner* — Joshua E Freeman

(57) ABSTRACT

A concentric collocated aiming device includes a prismatic hollow body, a dichroic mirror, a ball-and-socket attachment mechanism, a first electromagnetic (EM) radiation emission module, and a second EM radiation emission module. The dichroic mirror is angularly positioned within the prismatic hollow body so that a first light beam from the first EM radiation emission module is able to reflect about the dichroic mirror, and a second light beam from the second EM radiation emission module is able to transmit through the dichroic mirror. The first light beam and the second light beam are then able to exit the prismatic hollow body thus achieving the coalignment of dots at an operational distance. The ball-and-socket attachment mechanism functions as the mounting mechanism of the prismatic hollow body to allow 360-degree freedom of movement.

20 Claims, 7 Drawing Sheets

CONCENTRIC COLLOCATED AIMING DEVICE

The current application claims a priority to the U.S. Provisional Patent application Ser. No. 63/492,713 filed on Mar. 28, 2023.

FIELD OF THE INVENTION

The present invention relates generally to a firearm aiming apparatus. More specifically, the present invention is a module which is able to emit a laser beam from the same concentric point emanating from different and discrete laser diodes that can be of different in wavelengths, visible to human eye, and invisible to the human eye.

BACKGROUND OF THE INVENTION

Existing aiming modules utilize discrete lasers of differing wavelengths whose beams are separated by coplanar distances ranging from millimeters to centimeters. As a result, this approach reduces aiming accuracy by generating a significant displacement at normal working distance between the two lasers and complicates the coalignment of the two lasers during manufacturing. Some of the existing laser diodes that can emit laser beams from close to the same point for two different wavelengths but available in limited number of wavelengths. For example, inferred wavelengths and red visible wavelengths are available within the existing aiming modules, but other wavelengths such as visible green and visible blue are not available. Some of the existing aiming modules capable of combining two laser beams into one common beam are also available commercially; however, these are designed to couple said beams into a fiber.

The objective of the invention is to provide a collocated aiming device which allows for two discrete laser diodes to emit their radiation from the same collimated point. The advantage of this approach is to simplify the manufacturing process of co-aligning and collocating the two discrete lasers, improving accuracy by allowing for both beams of differing wavelength to closely illuminate the same point at a given distance, simplifying the alignment of the aiming laser beams to the barrel of a firearm, and increasing aiming accuracy. In addition to the optics which allow for two beams to be aimed from two discrete laser diodes following close to the same optical path, the present invention is capable of driving two discrete lasers of different wavelengths and power levels.

DETAILED DESCRIPTION OF THE INVENTION

All illustrations of the drawings are for the purpose of describing selected versions of the present invention and are not intended to limit the scope of the present invention.

Figure 1:
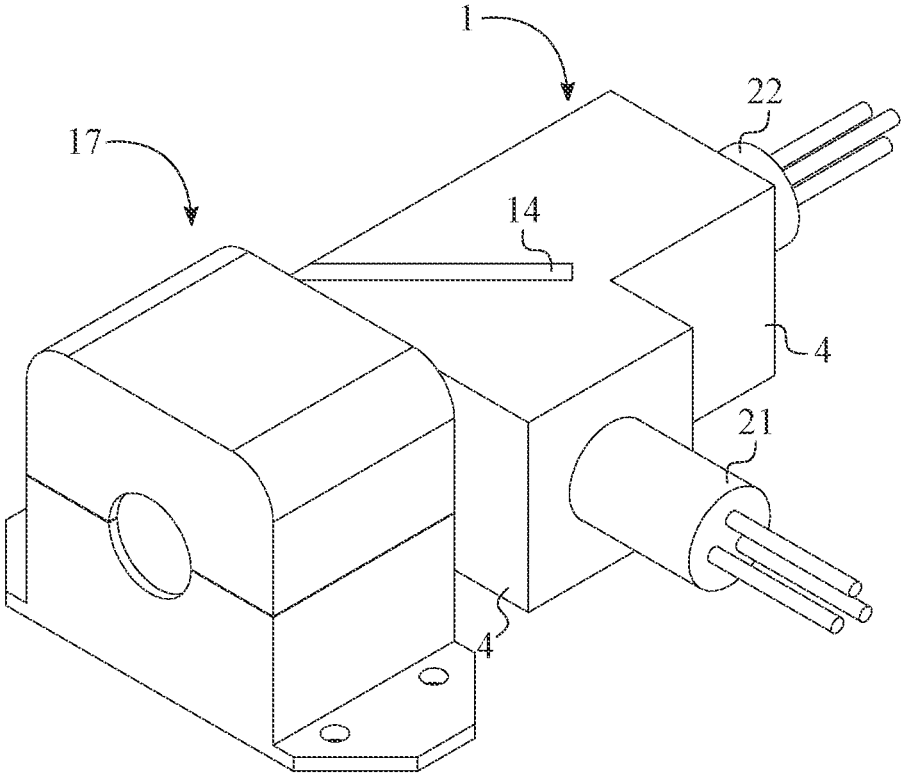
FIG. 1 is a top perspective view of the present invention.

The present invention is a concentric collocated aiming device for firearms or other similar apparatus. The present invention is configured with two laser modules with different wavelengths that are positioned orthogonal to each other. The laser modules emit two different laser diodes, which are able to output as coalignment dots at an operational distance. As shown in FIG. 1, the present invention comprises a prismatic hollow body 1, a dichroic mirror 14, a ball-and-socket attachment mechanism 17, a first electromagnetic (EM) radiation emission module 21, and a second EM radiation emission module 22.

Figure 2:
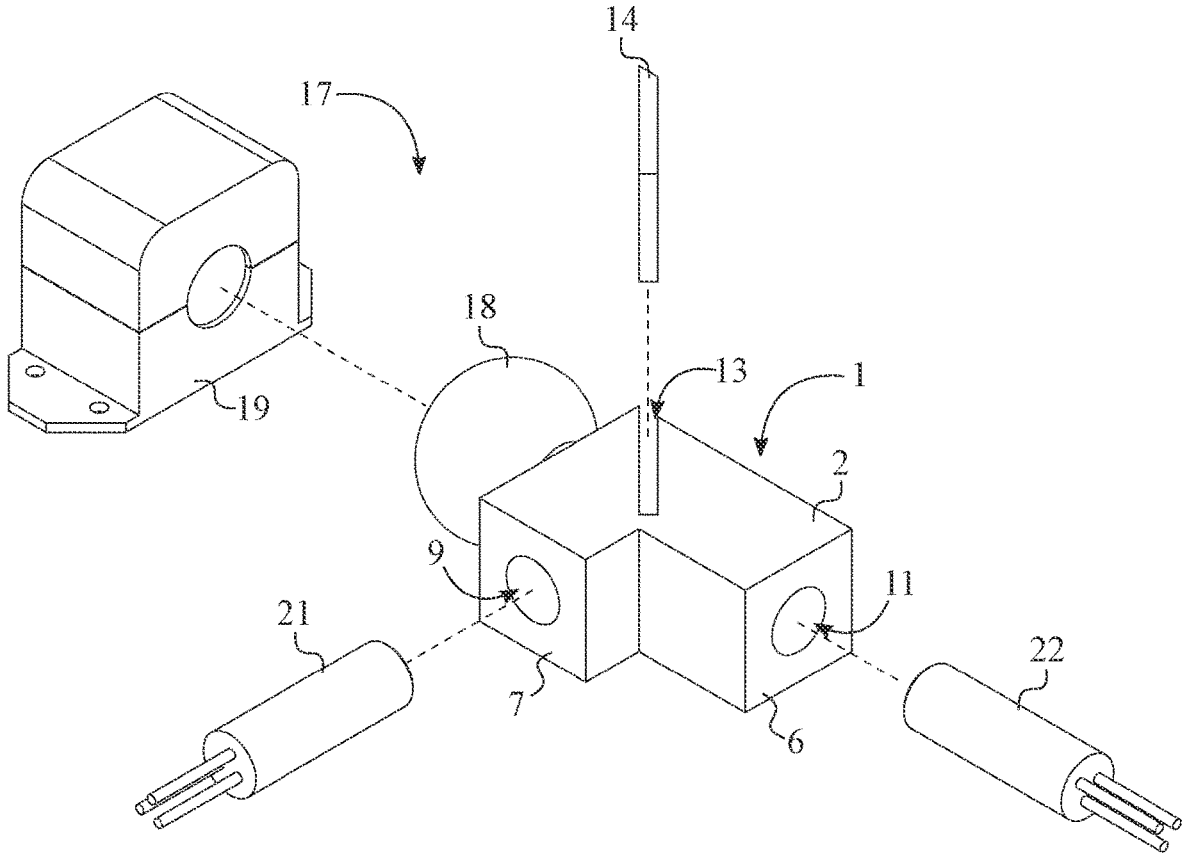
FIG. 2 is a top exploded view of the present invention.
Figure 3:
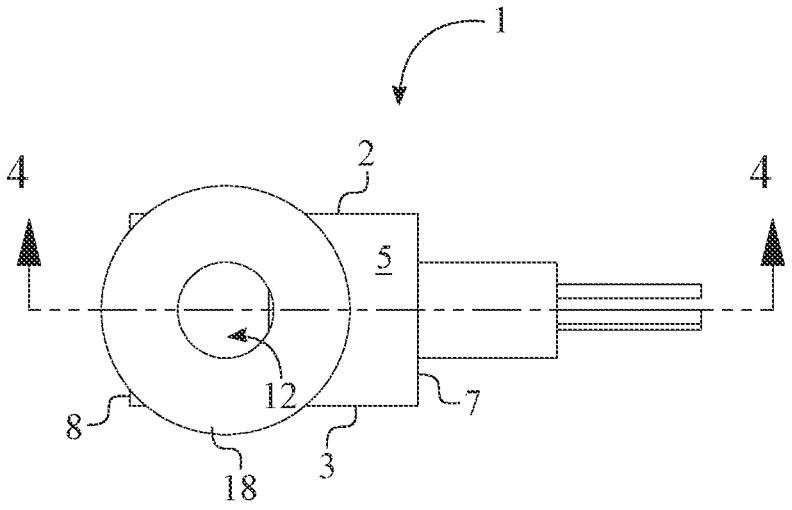
FIG. 3 is a front view of the present invention.

In reference to the general configuration of the present invention, as shown in FIG. 1 and FIG. 2, the first EM radiation emission module 21 and the second EM radiation emission module 22 are orthogonally mounted to the prismatic hollow body 1 and operated. The dichroic mirror 14 is angularly positioned within the prismatic hollow body 1 so that a first light beam from the first EM radiation emission module 21 is able to reflect about the dichroic mirror 14, and a second light beam from the second EM radiation emission module 22 is able to transmit through the dichroic mirror 14. Then, both the first light beam and the second light beam are able to exit the prismatic hollow body 1 thus achieving the coalignment of dots at an operational distance. As a result, the present invention is able to exhibit a coplanar separation distance between the first light beam and the second light beam of less than 100 microns. The ball-and-socket attachment mechanism 17 functions as the mounting mechanism between the present invention and the firearm so that the prismatic hollow body 1 can be pivotably moved about the ball-and-socket attachment mechanism 17.

Figure 5:
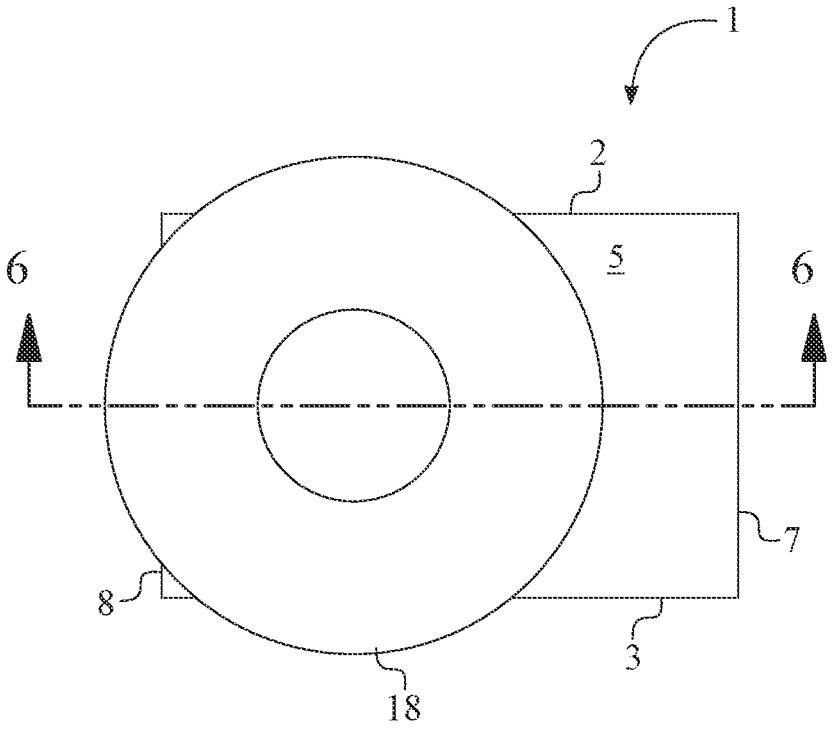
FIG. 5 is a front view of the prismatic hollow body of the present invention.
Figure 6:
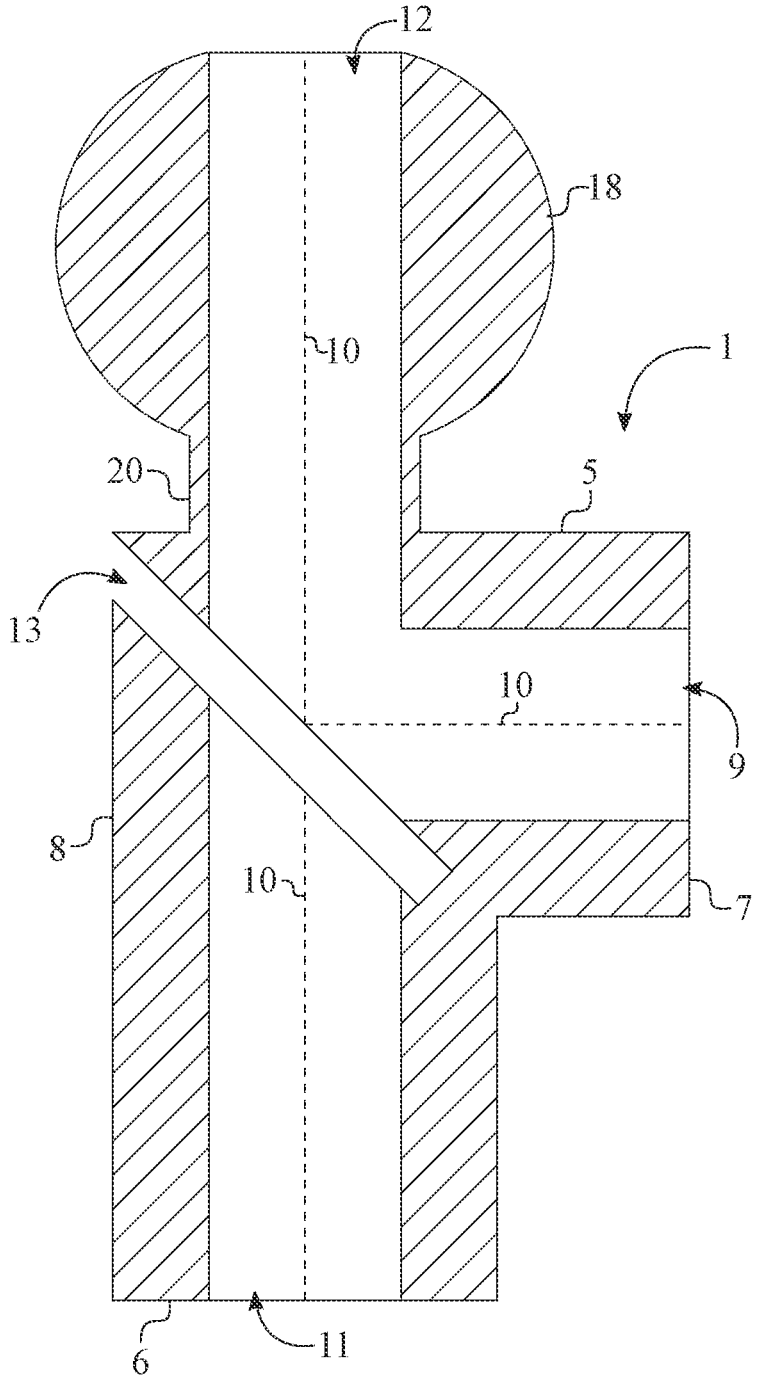
FIG. 6 is a cross-sectional view taken along line 6-6 in FIG. 5.

The prismatic hollow body 1 is formed into a geometric shape and functions as the main platform of the present invention. More specifically, the dichroic mirror 14, the ball-and-socket attachment mechanism 17, the first electromagnetic (EM) radiation emission module, and the second EM radiation emission module 22 are mounted or positioned in relation to the prismatic hollow body 1. In reference to FIG. 5 and FIG. 6, the prismatic hollow body 1 comprises a top base wall 2, a bottom base wall 3, a plurality of lateral walls 4, a first optical inlet 9, a second optical inlet 11, and an optical outlet 12. More specifically, the top base wall 2 and the bottom base wall 3 are a pair of L-shaped bases and positioned parallel and offset from each other. Each of the plurality of lateral walls 4 is perpendicularly connected in between the top base wall 2 and the bottom base wall 3 thus completing the general shape of the prismatic hollow body 1. The plurality of lateral walls 4 perimetrically encloses the prismatic hollow body 1 and comprises a farthest-front lateral wall 5, a farthest-rear lateral wall 6, a farthest-left lateral wall 7, and a farthest-right lateral wall 8.

Figure 4:
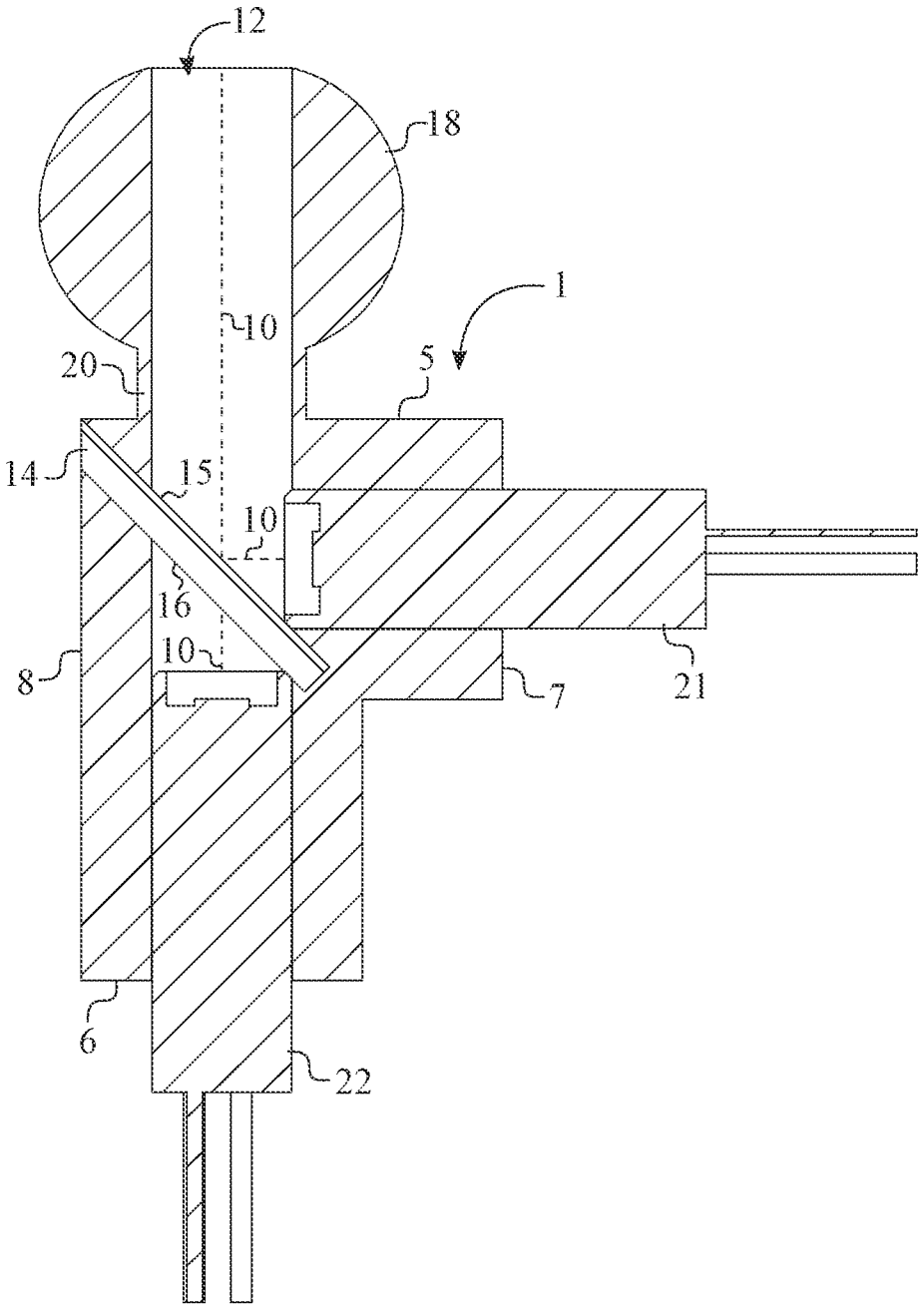
FIG. 4 is a cross-sectional view taken along line 4-4 in FIG. 3.

In reference to FIG. 2 and FIG. 4, the dichroic mirror 14 is mounted into the prismatic hollow body 1 and positioned at a 45-degree angle between the farthest-front lateral wall 5 and the farthest-right lateral wall 8. The positioning of the dichroic mirror 14 intersects with the first light beam and the second light beam thus aiming both the first light beam and the second light beam as coalignment dots at an operational distance. More specifically, the prismatic hollow body 1 may further comprise a precision slot 13. The precision slot 13 traverses through an intersection between the farthest-front lateral wall 5 and the farthest-right lateral wall 8 and into the prismatic hollow body 1 to facilitate the precision placement of the dichroic mirror 14. Furthermore, the precision slot 13 is positioned at a 45-degree angle with the farthest-front lateral wall 5 and positioned at a 45-degree angle with the farthest-right lateral wall 8. The precision slot 13 traverses through the top base wall 2 and into the prismatic hollow body 1 and positioned perpendicular with the top base wall 2 thus enabling the dichroic mirror 14 to be mounted within the precision slot 13.

In reference to FIG. 4, the dichroic mirror 14 may comprise a reflective face 15 and a transmission face 16 that are oppositely positioned of each other. More specifically, the reflective face 15 is oriented towards the first EM radiation emission module 21 to receive and reflect the first light beam. The transmission face 16 is oriented towards the second EM radiation emission module 22 to receive and transmit the second light beam.

In reference to FIGS. 3-6, the first optical inlet 9 traverses through the farthest-left lateral wall 7 thus facilitating the attachment of the first EM radiation emission module 21. More specifically, an emission axis 10 of the first optical inlet 9 is oriented normal to the farthest-left lateral wall 7 and intersects the dichroic mirror 14. The first EM radiation emission module 21 is positioned external to the prismatic hollow body 1 in such a way that the first EM radiation emission module 21 can be mounted adjacent to the farthest-left lateral wall 7 via an attachment mechanism. The attachment mechanism can be a twist lock, a magnetic attachment, a friction attachment, or any other type of industry standard attachment. Furthermore, the first EM radiation emission module 21, the first optical inlet 9, the dichroic mirror 14, and the optical outlet 12 are in serial optical communication with each other. As a result, the first light beam travels along the emission axis 10 of the first optical inlet 9 and into the dichroic mirror 14 so that the first light beam can be reflected. Once the first light beam is reflected via the dichroic mirror 14, the first light beam can be discharged from the prismatic hollow body 1 and onto a target within an operational distance.

In reference to FIGS. 3-6, the second optical inlet 11 traverses through the farthest-rear lateral wall 6 thus facilitating the attachment of the second EM radiation emission module 22. More specifically, an emission axis 10 of the second optical inlet 11 is oriented normal to the farthest-rear lateral wall 6 and intersects the dichroic mirror 14. The second EM radiation emission module 22 is positioned external to the prismatic hollow body 1 in such a way that the first EM radiation emission module 21 can be mounted adjacent to the farthest-rear lateral wall 6 via an attachment mechanism. The attachment mechanism can be a twist lock, a magnetic attachment, a friction attachment, or any other type of industry standard attachment. Furthermore, the second EM radiation emission module 22, the second optical inlet 11, the dichroic mirror 14, and the optical outlet 12 are in serial optical communication with each other. As a result, the second light beam travels along the emission axis 10 of the second optical inlet 11 and into the dichroic mirror 14 so that the second light beam can be transmitted. Once the second light beam is transmitted via the dichroic mirror 14, the second light beam can be discharged from the prismatic hollow body 1 and onto a target within an operational distance.

In reference to FIGS. 3-6, the optical outlet 12 traverses through the farthest-front lateral wall 5 and a ball portion 18 of the ball-and-socket attachment mechanism 17. An emission axis 10 of the optical outlet 12 is oriented normal to the farthest-front lateral wall 5 and originating from the dichroic mirror 14 thus allowing the first light beam and the second light beam to be discharged from the prismatic hollow body 1. The emission axis 10 of the first optical inlet 9, the emission axis 10 of the second optical inlet 11, and the emission axis 10 of the optical outlet 12 are positioned coplanar and coincident to each other so that the first light beam and the second light beam can co-align at an operational distance. More specifically, the emission axis 10 of the first optical inlet 9 is positioned perpendicular to the emission axis 10 of the second optical inlet 11 and the emission axis 10 of the optical outlet 12 in such a way that the emission axis 10 of the first optical inlet 9 intersects the reflective face 15 of the dichroic mirror 14 at a 45-degree angle. The emission axis 10 of the second optical inlet 11 is positioned collinear to the emission axis 10 of the optical outlet 12 in such a way that the emission axis 10 of the second optical inlet 11 intersects a transmission face 16 of the dichroic mirror 14 at a 45-degree angle.

Figure 7:
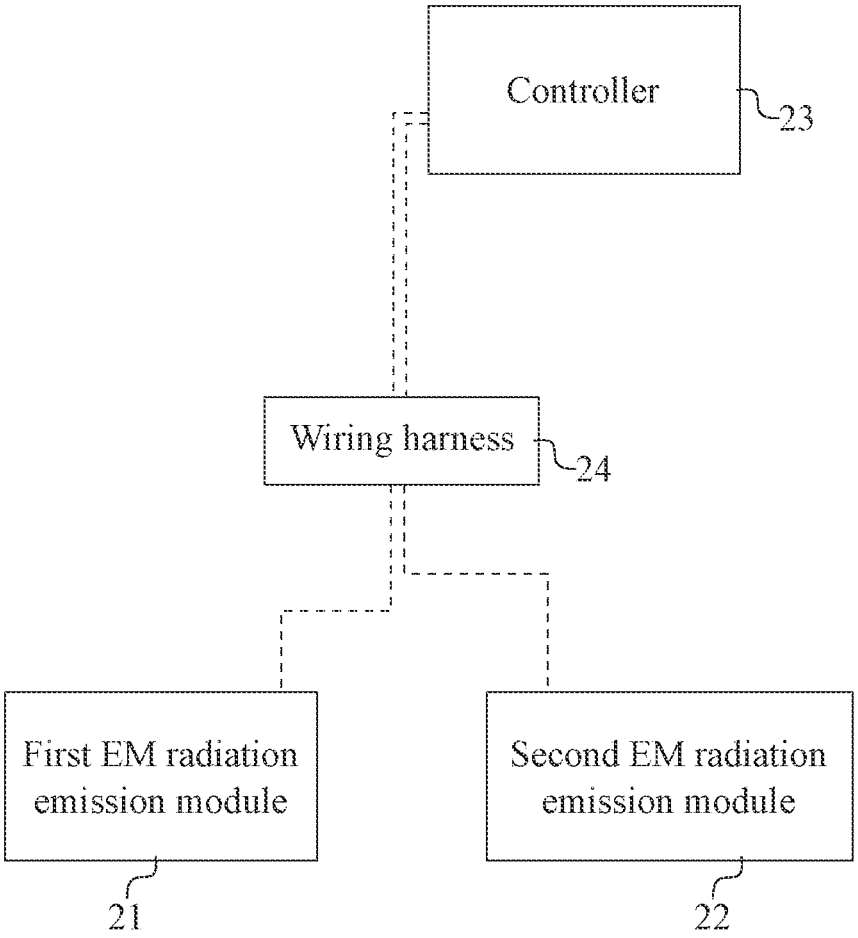
FIG. 7 is a schematic diagram showing the electronic connections of the present invention.

In reference to FIG. 7, the present invention may further comprise a controller 23 and a wiring harness 24 so that the first EM radiation emission module 21 and the second EM radiation emission module 22 can be operated. The controller 23 and the wiring harness 24 are positioned external to the prismatic hollow body 1 and preferably enclosed within a housing to protect from outside elements. The first EM radiation emission module 21 and the second EM radiation emission module 22 are electronically connected to the controller 23 by the wiring harness 24 so that the user can operate the present invention via the controller 23. More specifically, the controller 23 is equipped with features such as a high mode feature, a low mode feature, an Identification, friend or foe (IFF) feature, a Pulse Width Modulation (PWM) feature, or any other related features of the aiming devices. Furthermore, the first EM radiation emission module 21 is configured to generate EM radiation at a different wavelength than the second EM radiation emission module 22 so that the user can easily identify the first light beam and the second light beam. Preferably, the first EM radiation emission module 21 and the second EM radiation emission module 22 are a pair of discrete laser-diode modules as the first light beam is a first laser beam, and the second light beam is a second laser beam. The first laser beam and the second laser beam can also be visible or invisible to the unaided human eye.

In reference to FIG. 2 and FIG. 4, the ball-and-socket attachment mechanism 17 further comprises a socket portion 19 and may further comprise an extension nub 20. The ball portion 18 is positioned external to the prismatic hollow body 1 and mounted adjacent to the farthest-front lateral wall 5. As a result, the ball portion 18 can be pivotably mounted to the socket portion 19 thus allowing 360-degree freedom of movement for the prismatic hollow body 1. The socket portion 19 can be mounted to the firearm or any other objects that requires the attachment of the present invention. The extension nub 20 is positioned external to the prismatic hollow body 1 and connected in between the ball portion 18 and the farthest-front lateral wall 5. Resultantly, the extension nub 20 enables the prismatic hollow body 1 to be pivotably connected to the socket portion 19 without any obstructions. In other words, the extension nub 20 creates a gap between the prismatic hollow body 1 and the socket portion 19 so that the prismatic hollow body 1 can be freely moved as the farthest-front lateral wall 5 does not collide with the socket portion 19.

It is understood that the first EM radiation emission module 21, the second EM radiation emission module 22, and the controller 23 are electrically powered through an external power source without deviating from the scope of the functionality. It is understood also that the present invention allows for the concentric emission of aiming beams of any wavelength that are available with discrete single beams of the first EM radiation emission module 21 and the second EM radiation emission module 22. It is also understood that the present invention intends to separately aim two discrete beams (the first light beam and the second light beam) into free-space, not into a fiber, for the purpose of aiming assistance.

Although the invention has been explained in relation to its preferred embodiment, it is to be understood that many other possible modifications and variations can be made without departing from the spirit and scope of the invention as hereinafter claimed.

What is claimed is:

1. A concentric collocated aiming device comprising:

a prismatic hollow body;

a dichroic mirror;

a ball-and-socket attachment mechanism;

the prismatic hollow body comprising a top base wall, a bottom base wall, a plurality of lateral walls, a first optical inlet, a second optical inlet, and an optical outlet;

the ball-and-socket attachment mechanism comprising a ball portion and a socket portion;

the plurality of lateral walls comprising a farthest-front lateral wall, a farthest-rear lateral wall, a farthest-left lateral wall, and a farthest-right lateral wall;

the dichroic mirror being mounted into the prismatic hollow body;

the dichroic mirror being mounted at a 45-degree angle between the farthest-front lateral wall and the farthest-right lateral wall;

the first optical inlet traversing through the farthest-left lateral wall;

an emission axis of the first optical inlet being oriented normal to the farthest-left lateral wall and intersecting the dichroic mirror;

the second optical inlet traversing through the farthest-rear lateral wall;

an emission axis of the second optical inlet being oriented normal to the farthest-rear lateral wall and intersecting the dichroic mirror;

the ball portion being positioned external to the prismatic hollow body;

the ball portion being mounted adjacent to the farthest-front lateral wall;

the optical outlet traversing through the farthest-front lateral wall and the ball portion;

an emission axis of the optical outlet being oriented normal to the farthest-front lateral wall and originating from the dichroic mirror; and the ball portion being pivotably mounted to the socket portion.

2. The concentric collocated aiming device as claimed in claim 1 comprising:

a first electromagnetic (EM) radiation emission module;

a second EM radiation emission module;

the first EM radiation emission module and the second EM radiation emission module being positioned external to the prismatic hollow body;

the first EM radiation emission module, the first optical inlet, the dichroic mirror, and the optical outlet being in serial optical communication with each other; and the second EM radiation emission module, the second optical inlet, the dichroic mirror, and the optical outlet being in serial optical communication with each other.

3. The concentric collocated aiming device as claimed in claim 2 comprising:

the first EM radiation emission module being mounted adjacent to the farthest-left lateral wall; and the second EM radiation emission module being mounted adjacent to the farthest-rear lateral wall.

4. The concentric collocated aiming device as claimed in claim 2, wherein the first EM radiation emission module is configured to generate EM radiation at a different wavelength than the second EM radiation emission module.

5. The concentric collocated aiming device as claimed in claim 2, wherein the first EM radiation emission module and the second EM radiation emission module are a pair of discrete laser-diode modules.

6. The concentric collocated aiming device as claimed in claim 2 comprising:

a controller;

a wiring harness;

the controller and the wiring harness being positioned external to the prismatic hollow body; and the first EM radiation emission module and the second EM radiation emission module being electronically connected to the controller by the wiring harness.

7. The concentric collocated aiming device as claimed in claim 1 comprising:

the prismatic hollow body further comprising a precision slot;

the precision slot traversing through an intersection between the farthest-front lateral wall and the farthest-right lateral wall and into the prismatic hollow body;

the precision slot being positioned at a 45-degree angle with the farthest-front lateral wall;

the precision slot being positioned at a 45-degree angle with the farthest-right lateral wall;

the precision slot further traversing through the top base wall and into the prismatic hollow body;

the precision slot being positioned perpendicular with the top base wall; and the dichroic mirror being mounted within the precision slot.

8. The concentric collocated aiming device as claimed in claim 1 comprising:

the ball-and-socket attachment mechanism further comprising an extension nub;

the extension nub being positioned external to the prismatic hollow body; and the extension nub being connected in between the ball portion and the farthest-front lateral wall.

9. The concentric collocated aiming device as claimed in claim 1, wherein the top base wall and the bottom base wall are a pair of L-shaped bases.

10. The concentric collocated aiming device as claimed in claim 1 comprising:

the top base wall and the bottom base wall being positioned parallel and offset from each other; and each of the plurality of lateral walls being perpendicularly connected in between the top base wall and the bottom base wall.

11. The concentric collocated aiming device as claimed in claim 1 comprising:

the emission axis of the first optical inlet, the emission axis of the second optical inlet, and the emission axis of the optical outlet being coplanar and coincident to each other;

the emission axis of the first optical inlet being positioned perpendicular to the emission axis of the second optical inlet and the emission axis of the optical outlet;

the emission axis of the first optical inlet intersecting a reflective face of the dichroic mirror at a 45-degree angle;

the emission axis of the second optical inlet being positioned collinear to the emission axis of the optical outlet; and the emission axis of the second optical inlet intersecting a transmission face of the dichroic mirror at a 45-degree angle.

12. A concentric collocated aiming device comprising:

a prismatic hollow body;

a dichroic mirror;

a ball-and-socket attachment mechanism;

a first electromagnetic (EM) radiation emission module;

a second EM radiation emission module;

the prismatic hollow body comprising a top base wall, a bottom base wall, a plurality of lateral walls, a first optical inlet, a second optical inlet, and an optical outlet;

the ball-and-socket attachment mechanism comprising a ball portion and a socket portion;

the plurality of lateral walls comprising a farthest-front lateral wall, a farthest-rear lateral wall, a farthest-left lateral wall, and a farthest-right lateral wall;

the dichroic mirror being mounted into the prismatic hollow body;

the dichroic mirror being mounted at a 45-degree angle between the farthest-front lateral wall and the farthest-right lateral wall;

the first optical inlet traversing through the farthest-left lateral wall;

an emission axis of the first optical inlet being oriented normal to the farthest-left lateral wall and intersecting the dichroic mirror;

the second optical inlet traversing through the farthest-rear lateral wall;

an emission axis of the second optical inlet being oriented normal to the farthest-rear lateral wall and intersecting the dichroic mirror;

the ball portion being positioned external to the prismatic hollow body;

the ball portion being mounted adjacent to the farthest-front lateral wall;

the optical outlet traversing through the farthest-front lateral wall and the ball portion;

an emission axis of the optical outlet being oriented normal to the farthest-front lateral wall and originating from the dichroic mirror;

the ball portion being pivotably mounted to the socket portion;

the first EM radiation emission module, the first optical inlet, the dichroic mirror, and the optical outlet being in serial optical communication with each other; and the second EM radiation emission module, the second optical inlet, the dichroic mirror, and the optical outlet being in serial optical communication with each other.

13. The concentric collocated aiming device as claimed in claim 12 comprising:

the first EM radiation emission module and the second EM radiation emission module being positioned external to the prismatic hollow body;

the first EM radiation emission module being mounted adjacent to the farthest-left lateral wall; and the second EM radiation emission module being mounted adjacent to the farthest-rear lateral wall.

14. The concentric collocated aiming device as claimed in claim 12, wherein the first EM radiation emission module is configured to generate EM radiation at a different wavelength than the second EM radiation emission module.

15. The concentric collocated aiming device as claimed in claim 12, wherein the first EM radiation emission module and the second EM radiation emission module are a pair of discrete laser-diode modules.

16. The concentric collocated aiming device as claimed in claim 12 comprising:

a controller;

a wiring harness;

the controller and the wiring harness being positioned external to the prismatic hollow body; and the first EM radiation emission module and the second EM radiation emission module being electronically connected to the controller by the wiring harness.

17. The concentric collocated aiming device as claimed in claim 12 comprising:

the prismatic hollow body further comprising a precision slot;

the precision slot traversing through an intersection between the farthest-front lateral wall and the farthest-right lateral wall and into the prismatic hollow body;

the precision slot being positioned at a 45-degree angle with the farthest-front lateral wall;

the precision slot being positioned at a 45-degree angle with the farthest-right lateral wall;

the precision slot further traversing through the top base wall and into the prismatic hollow body;

the precision slot being positioned perpendicular with the top base wall; and the dichroic mirror being mounted within the precision slot.

18. The concentric collocated aiming device as claimed in claim 12 comprising:

the ball-and-socket attachment mechanism further comprising an extension nub;

the extension nub being positioned external to the prismatic hollow body; and the extension nub being connected in between the ball portion and the farthest-front lateral wall.

19. The concentric collocated aiming device as claimed in claim 12 comprising:

the top base wall and the bottom base wall being positioned parallel and offset from each other;

each of the plurality of lateral walls being perpendicularly connected in between the top base wall and the bottom base wall; and the top base wall and the bottom base wall being a pair of L-shaped bases.

20. The concentric collocated aiming device as claimed in claim 12 comprising:

the emission axis of the first optical inlet, the emission axis of the second optical inlet, and the emission axis of the optical outlet being coplanar and coincident to each other;

the emission axis of the first optical inlet being positioned perpendicular to the emission axis of the second optical inlet and the emission axis of the optical outlet;

the emission axis of the first optical inlet intersecting a reflective face of the dichroic mirror at a 45-degree angle;

the emission axis of the second optical inlet being positioned collinear to the emission axis of the optical outlet; and the emission axis of the second optical inlet intersecting a transmission face of the dichroic mirror at a 45-degree angle.

* * * * *